US011035642B2

(12) United States Patent
Nishikawa et al.

(10) Patent No.: US 11,035,642 B2
(45) Date of Patent: Jun. 15, 2021

(54) ARCHERY CUSHION PLUNGER MOUNTING DEVICE

(71) Applicant: NISHIKAWA SEIKI SEISAKUSHO CO., LTD., Tokyo (JP)

(72) Inventors: Yoshihisa Nishikawa, Tokyo (JP); Yoshiyuki Kuribayashi, Tokyo (JP); Sachio Hongo, Tokyo (JP)

(73) Assignee: NISHIKAWA SEIKI SEISAKUSHO CO., LTD., Tokyo (JP)

( * ) Notice: Subject to any disclaimer, the term of this patent is extended or adjusted under 35 U.S.C. 154(b) by 0 days.

(21) Appl. No.: 16/633,472

(22) PCT Filed: Jul. 23, 2018

(86) PCT No.: PCT/JP2018/027544
§ 371 (c)(1),
(2) Date: Jan. 23, 2020

(87) PCT Pub. No.: WO2019/146142
PCT Pub. Date: Aug. 1, 2019

(65) Prior Publication Data

US 2020/0224994 A1 Jul. 16, 2020

(30) Foreign Application Priority Data

Jan. 26, 2018 (JP) ..... JP2018-011635

(51) Int. Cl.
*F41B 5/14* (2006.01)

(52) U.S. Cl.
CPC ..... *F41B 5/148* (2013.01); *F41B 5/1438* (2013.01); *F41B 5/143* (2013.01); *F41B 5/1426* (2013.01)

(58) Field of Classification Search
CPC ..... F41B 5/14; F41B 5/143; F41B 5/1438
See application file for complete search history.

(56) References Cited

U.S. PATENT DOCUMENTS 4,542,731 A 9/1985 Quartino
5,005,554 A * 4/1991 Shepley ..... F41B 5/0026 124/24.1

(Continued)

FOREIGN PATENT DOCUMENTS

JP S59-185998 A 10/1984
JP H09-273894 A 10/1997
JP 2008-020178 A 1/2008

OTHER PUBLICATIONS

International Search Report issued in Application No. PCT/JP2018/027544, dated Sep. 25, 2018.

*Primary Examiner* — John A Ricci
(74) *Attorney, Agent, or Firm* — Michael Best & Friedrich LLP

(57) ABSTRACT

By replacing a block with a plurality of holes reversed in the longitudinal direction of a handle riser, more types of cushion plunger mounting holes than cushion plunger mounting holes are obtained. A cushion plunger mounting device A includes: a block 31 including two cushion plunger mounting holes 32 for mounting a cushion plunger 41 which are deviated from the center of the block 31 in a manner to be arranged in a row in the longitudinal direction of the handle riser 21 when the block is attached to the handle riser 21, a slotted hole 22 penetrating from one side of the handle riser 21 of the archery 11 to the other side, in a manner to overlap the cushion plunger mounting holes 32 in the longitudinal direction of the archery 11 when the block 31 is attached to the handle riser 21, and a block housing hole 33 for housing the block 31, located around the slotted hole 22 on one side of the handle riser 21 without penetrating up to the other side.

6 Claims, 7 Drawing Sheets

(56) References Cited

U.S. PATENT DOCUMENTS

| | | | | |
|---|---|---|---|---|
| 5,123,396 | A * | 6/1992 | Shepley | F41B 5/066<br>124/25.5 |
| 6,612,299 | B2 * | 9/2003 | Martin | F41B 5/14<br>124/86 |
| 6,889,683 | B1 * | 5/2005 | Smith | F41B 5/14<br>124/86 |
| 7,347,196 | B1 * | 3/2008 | Shepley, Jr. | F41G 1/467<br>124/87 |

* cited by examiner

ARCHERY CUSHION PLUNGER MOUNTING DEVICE

CROSS REFERENCE TO RELATED APPLICATION

The present application is based on and claims the benefit of priority of International Application No. PCT/JP2018/027544, filed on Jul. 23, 2018, which claims priority to Japanese Patent Application No. 2018-011635, filed on Jan. 26, 2018, the entire contents of which is incorporated herein by reference.

TECHNICAL FIELD

The present invention relates to archery. More particularly the present invention relates to a cushion plunger to be mounted on an archery bow, or a plunger mounting device.

BACKGROUND ART

In archery, the problem called archers paradox or archery paradox is known. The cushion plunger was invented in order to compensate for archers paradox.

The archery cushion plunger has been mounted on the archery bow by being screwed into an internal thread as a mounting part which consists of a hole penetrating the archery handle horizontally, and perpendicularly to the direction of the arrow. The tip of the cushion plunger performs a very important function to restrict the arrow trajectory above the arrow rest laterally. The position of such a cushion plunger in the archery bow has been fixed.

As conventional archery cushion plungers, those described in Japanese Patent Application Laid-Open No. 1984-185998 "BOW FOR ARCHERY" (PTL 1), Japanese Patent Application Laid-Open No. 1997-273894 "ARCHERY AND ARCHERY CUSHION PLUNGER ROTOR" (PTL 2), and Japanese Patent Application Laid-Open No. 2008-20178 "ARROW HOLDING DEVICE IN ARCHERY" (PTL 3) are known.

It is described that "the cushion plunger absorbs the vibration or meandering of the arrow and restricts the arrow flying direction" (PTL 3, Japanese Patent Application Laid-Open No. 2008-20178 [0003]) and that "the cushion plunger has a tip which protrudes perpendicularly to the arrow moving direction at the time of shooting" (ditto [0004]).

It is described that "in an archery game, the arrow spine (arrow hardness and thickness) is determined according to the strength of the archery body used by the archer and the length of the arrow. The arrow spine gives an influence to the game since the arrow does not pass through the same trajectory even when the spine value is slightly different. For this reason, although the arrow spine to be determined is usually selected using a reference value in a chart table as a guide, it subtly differs depending on the power strength and personal quality of each player or the type of game and it is very important and very difficult for each archer to select the best arrow or make an adjustment" (see PTL 2 [0006]).

It is described that "the elevation angle between the virtual line of the archers pushing hand and the horizon line is one of the important factors to make the arrow hit the target accurately in an archery game. Generally, there is a tendency that when the elevation angle is larger, it is more difficult to hold the pushing hand horizontal. Particularly in an archery long-distance game (90 m, 70 m), the elevation angle of the pushing hand must be increased and one problem is that since the pushing hand is moved upward, control of the pushing hand becomes unstable and it is difficult to launch the arrow" (see PTL 2 [0007]).

It is described that "as other factors to determine the elevation angle of the archer, elevation angle G of the archer is determined in relation to three height position factors: height depending on the personal quality of each archer, including the distance from the archer's eyes to his/her jaw tip, the archer's height and the finger hooking height position of each archer; the height position of the sighting device (sight); and the height position of the cushion plunger and arrow rest" (see PTL 2 [0008]).

It is described that "when the cushion plunger and arrow rest which are fixed as in the past are used, for a person with a relatively short distance between the eyes and jaw, a person with a high finger hooking position or a short-statured person, when launching the arrow with the sighting device at the standard height position, since the height of the target (130 cm) is fixed, the whole archery bow will be in a lower position and the arrow will fly more downward than usual. Therefore, the position of the sighting device must be lowered to adjust the arrow flying direction. One problem is that when the position of the sighting device is lowered, the elevation angle of the archer is larger and thus control of the pushing hand tends to become unstable as in long-distance games" (see PTL 2 [0009]).

It is described that "for a person with a relatively long distance D between the eyes and jaw, a person with a low finger hooking position or a tall person, when launching the arrow with the sighting device at the standard height position, since the height of the target is fixed, the whole archery bow will be in a higher position and the arrow will fly more upward than usual. Therefore, the position of the sighting device must be raised to adjust the arrow flying direction. One problem is that when the position of the sighting device is raised, the elevation angle of the archer is smaller, but in a short-distance game such as 5 m game, the pushing hand will be oriented extremely downward and control of the pushing hand will be difficult" (see PTL 2 [0010]).

It is described that "the height position of the sighting device must be changed according to whether it is a long-distance game or short-distance game, whether the distance between the eyes and jaw tip of the archer is large or small, and whether the archer is tall or short, and one problem is that when the cushion plunger and arrow rest are fixed as in the past, inevitably the elevation angle of the pushing hand should largely change" (see PTL 2 [0011]).

It is described that "in an archery game, the bow pulling force differs between the beginner and the experienced person. Therefore, even with the same bow owned by a person, there is a problem that when the experienced archer pulls it, the bow pulling force is large and the tip of the arrow may not rest on the cushion plunger and arrow rest. Also, if the purchased arrow is too long or the arrow 52 does not fly straight, in the past there has been no other way than replacing the expensive arrow to solve the problem" (see PTL 2 [0012]).

Therefore, according to Japanese Patent Application Laid-Open No. 1997-273894 "ARCHERY AND ARCHERY CUSHION PLUNGER ROTOR" (PTL 2), in order to solve "the problem that when the archery cushion plunger is fixed, the elevation angle of the pushing hand must be increased depending on the archers height or the type of game", there are provided "a cushion plunger rotor and archery with a cushion plunger rotor in which a rotor on which an archery cushion plunger is mounted is rotatably provided on a handle part, the position of the part of the rotor on which the cushion plunger is mounted is different from the position of the center of rotation of the rotor, and the position of the cushion plunger mounting part can be changed by rotor rotation fixing means".

This is based on the premise that in consideration of the balance between the upper and lower limbs, the angle between the arrow and bow is not the right angle and generally the nocking point (arrow nock position in the bow) is set at a height of ⅛ to ¼ inch above the right angle, which is a known fact and also true for the present invention.

CITATION LIST

Patent Literature

PTL 1: Japanese Patent Application Laid-Open No. 1984-185998

PTL 2: Japanese Patent Application Laid-Open No. 1997-273894

PTL 3: Japanese Patent Application Laid-Open No. 2008-20178

SUMMARY OF INVENTION

Technical Problem

Japanese Patent Application Laid-Open No. 1997-273894 "ARCHERY AND ARCHERY CUSHION PLUNGER ROTOR" (PTL 2) describes that the cushion plunger can be mounted anywhere on a concentric circle of the cushion plunger rotor provided rotatably, but if the cushion plunger is not mounted on a line just above the pivot point (rotation axis), that is it is mounted out of the line just above the pivot point, it is meaningless.

Even when the cushion plunger rotor is used, there is a problem that actually only two positions on the line just above the pivot point are used.

Solution to Problem

According to one aspect of the present invention, there is provided a cushion plunger mounting device comprising:

a block provided so that a plurality of cushion plunger mounting holes for mounting a cushion plunger are arranged in a row in a longitudinal direction of a handle riser when the block is attached to the handle riser of an archery bow;

a slotted hole penetrating from one side of the handle riser of the archery bow to another side, in a longitudinal direction of the archery bow to overlap to the cushion plunger mounting holes when the block is attached to the handle riser; and a block housing hole for housing the block, located around the slotted hole on one side of the handle riser without penetrating up to the other side.

In the present invention, it is further that the cushion plunger mounting holes are deviated from a center of the block in the longitudinal direction of the handle riser.

In the present invention, it is further that the cushion plunger mounting holes are two holes.

Advantageous Effects of Invention

By replacing the block in the block housing hole with a plurality of cushion plunger mounting holes reversed in the longitudinal direction of the handle riser, the slotted hole can offer more types of cushion plunger mounting holes than the cushion plunger mounting holes.

If two cushion plunger mounting holes are provided, by replacing the block in the block housing hole with the cushion plunger mounting holes reversed in the longitudinal direction of the handle riser, the slotted hole offers four types of cushion plunger mounting holes.

DESCRIPTION OF EMBODIMENTS

Figure 1:
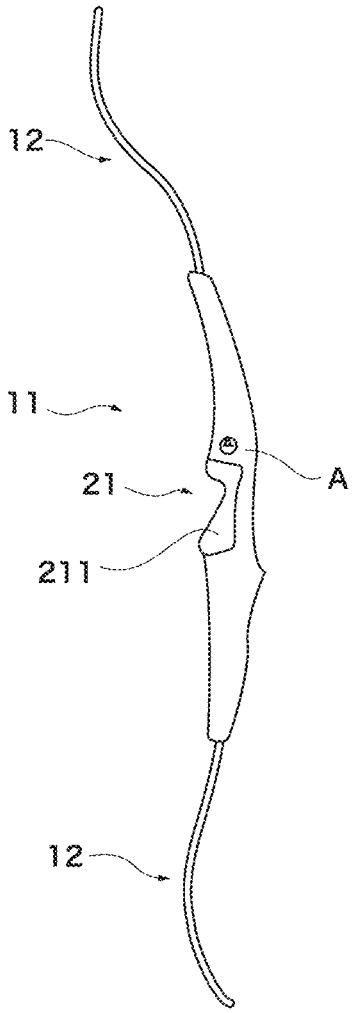
FIG. 1 is a front view of the whole archery bow according to an embodiment of the present invention.
Figure 2:
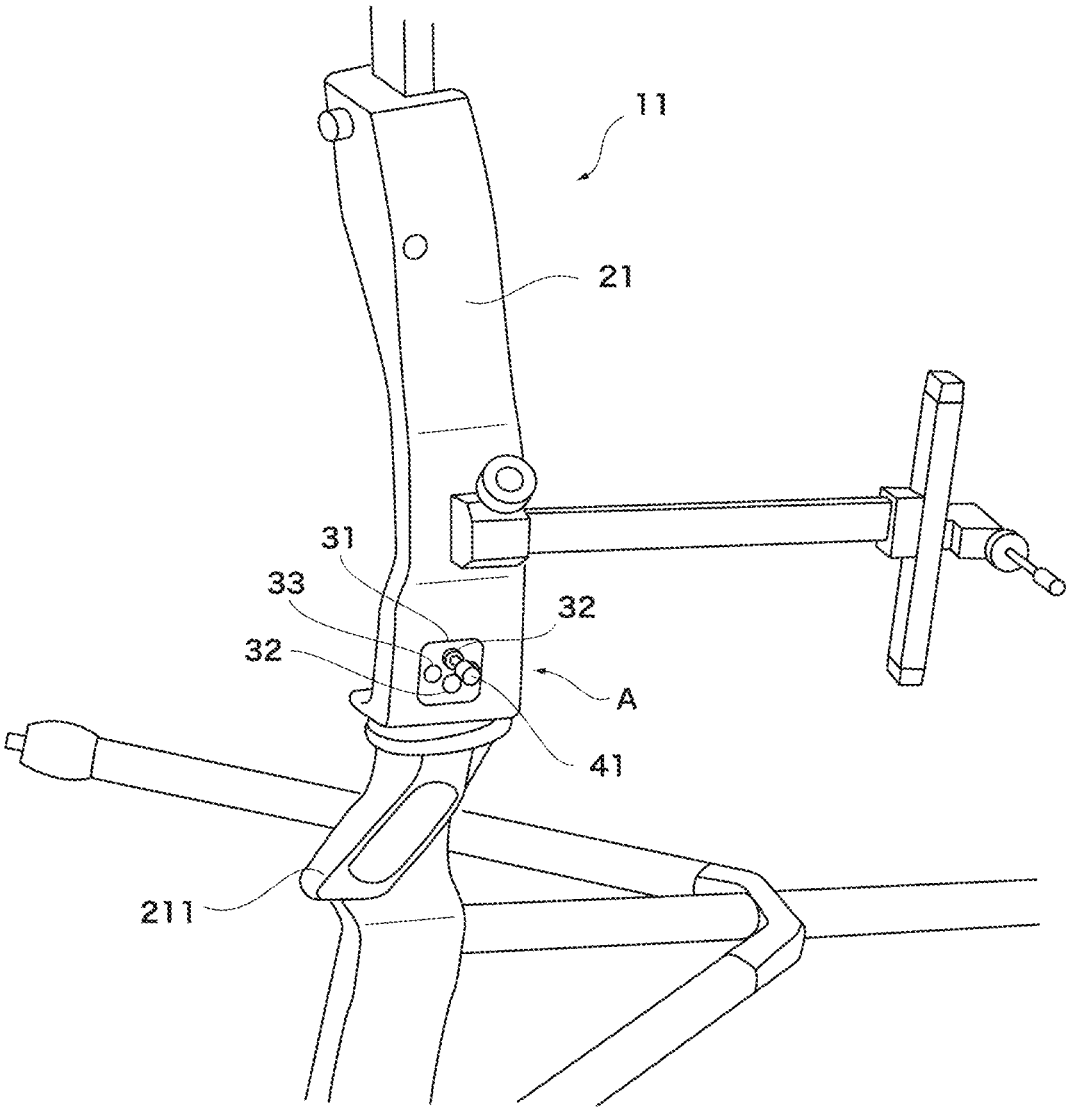
FIG. 2 is a fragmentary enlarged front view of the handle riser of the archery bow according to the embodiment of the present invention.
Figure 3:
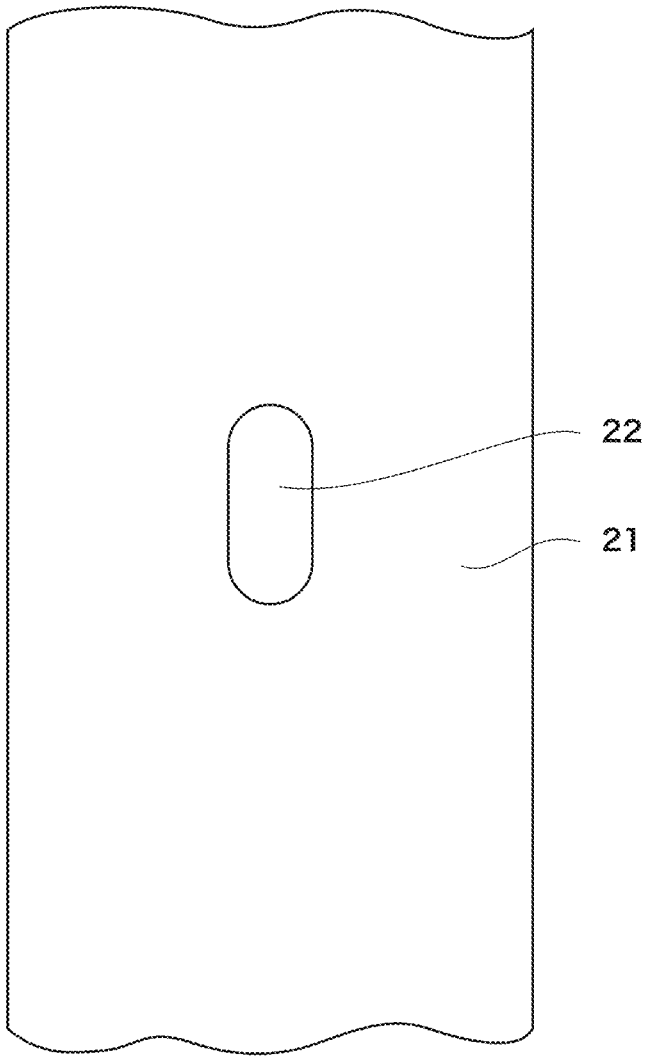
FIG. 3 is a fragmentary enlarged perspective view of the front side of the cushion plunger mounting part of the handle riser according to the embodiment of the present invention.
Figure 4:
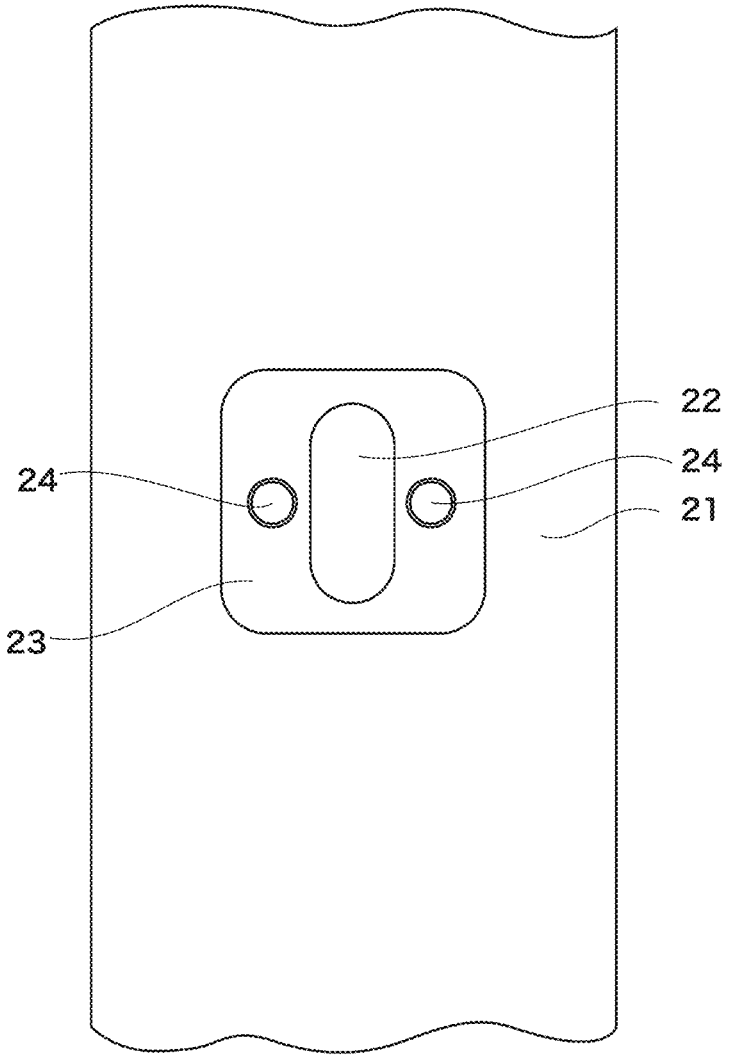
FIG. 4 is a fragmentary enlarged perspective view of the back side of the cushion plunger mounting part of the handle riser according to the embodiment of the present invention.

An embodiment will be described referring to FIGS. 1 to 9.

Here, 11 denotes archery bow, 21 denotes a handle riser, and 12 denotes a limb. In the archery bow 11, the limbs 12 are attached to each of the ends of the handle riser 21 located in the center. 41 denotes a cushion plunger, and 211 denotes a grip part. The grip part 211 is located in the center of the handle riser 21.

22 denotes a slotted hole. The slotted hole 22 extends along the longitudinal direction of the handle riser 21 of the archery bow 11, penetrating from the front side of the handle riser 21 as one side of the handle riser 21 of the archery bow 11 to the back side of the handle riser 21 as its other side.

The slotted hole 22 measures 28 mm in length and 11 mm in width in this embodiment.

The slotted hole 22 is made in the handle riser 21 body in the lengthwise direction, namely in the longitudinal direction of the handle riser 21, on the front side of the handle riser 21 so that the cushion plunger 41 can be adjusted only in the lengthwise direction, namely in the longitudinal direction of the handle riser 21.

23 denotes a block housing hole. The block housing hole 23 has a larger size including the slotted hole 22 and is formed with a concave cross section by grinding the surface of the back side of the handle riser 21 as one side of the handle riser 21, though it does not penetrate up to the front side of the handle riser 21 as the other side. The block housing hole 23 houses a block 31.

The block housing hole 23 has a square shape on the surface of one side of the handle riser 21. In this embodiment, it measures 34 mm in length and width. The slotted hole 22 is made in the center of the block housing hole 23 in the longitudinal direction of the handle riser 21.

The margins from both the ends of the slotted hole 22 to the edges of the block housing hole 23 each measure 3 mm in this embodiment.

24 denotes a block fixing part. Block fixing parts 24 are provided as internally threaded holes on the bottom of the block housing hole 23 on both sides with the slotted hole 22 between them.

31 denotes a block. 32 denotes a cushion plunger mounting hole.

In the block 31, a plurality of cushion plunger mounting holes 32 for mounting the cushion plunger 41 are arranged in a row in the center as internally threaded holes. The cushion plunger mounting holes 32 are arranged in the longitudinal direction of the handle riser 21 when mounted on the handle riser 21 of the archery bow 11.

The cushion plunger mounting holes 32 are located in a manner to overlap the slotted hole 22 when the block 31 is mounted on the handle riser 21.

In this embodiment, two cushion plunger mounting holes 32 are provided.

33 denotes a block mounting hole. Block mounting holes 33 are provided as internally threaded holes on both sides with the cushion plunger mounting holes 32 between them.

After the block 31 is placed in the block housing hole 23, the block mounting holes 33 and the block fixing parts 24 are laid one upon the other and bolts are passed through the handle riser 21 to fix the block 31.

The diameter of the internally threaded holes should be 6 to 15 mm; in this embodiment, the internally threaded holes have a diameter of 11 mm.

Figure 5:
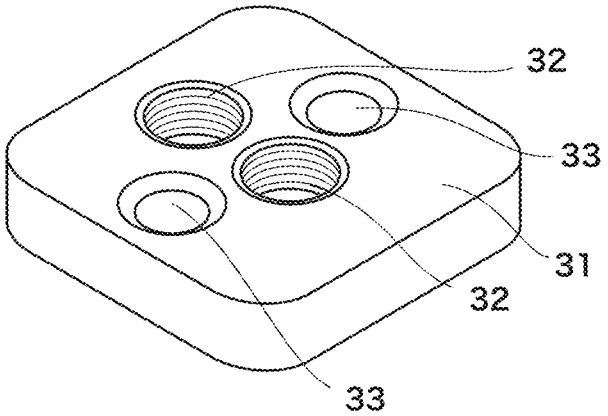
FIG. 5 is a perspective view of the cushion plunger mounting block according to the embodiment of the present invention.
Figure 6:
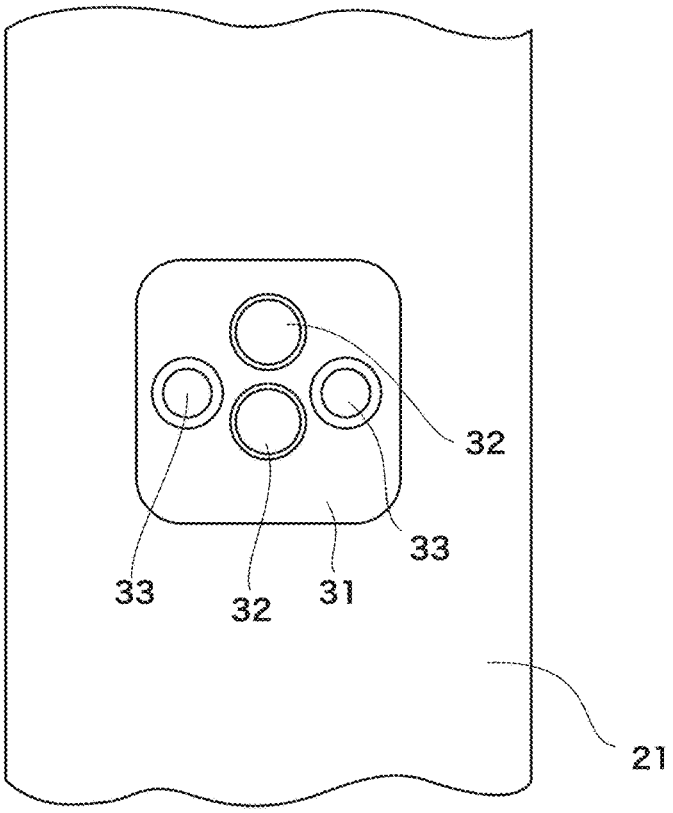
FIG. 6 is a fragmentary enlarged perspective view of the back side of the cushion plunger mounting part of the handle riser according to the embodiment of the present invention, in which the cushion plunger mounting block is fitted to the back side.
Figure 7:
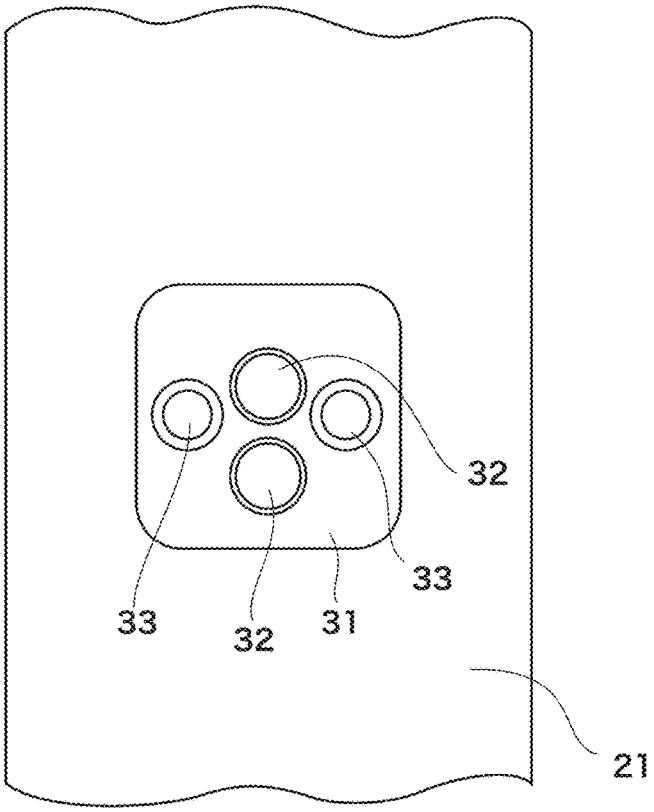
FIG. 7 is a fragmentary enlarged perspective view of the back side of the cushion plunger mounting part of the handle riser according to the embodiment of the present invention, in which the cushion plunger mounting block is fitted to the back side upside down with respect to the one shown in FIG. 6 in the longitudinal direction of the handle riser.
Figure 8:
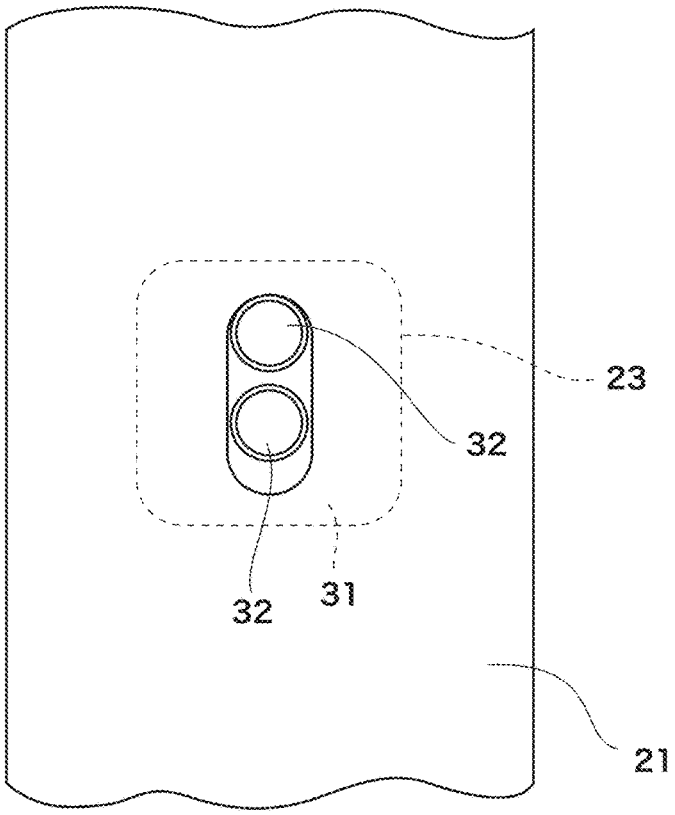
FIG. 8 is a fragmentary enlarged perspective view of the front side of the cushion plunger mounting part of the handle riser according to the embodiment of the present invention, in which the cushion plunger mounting block is fitted to the back side as shown in FIG. 6.
Figure 9:
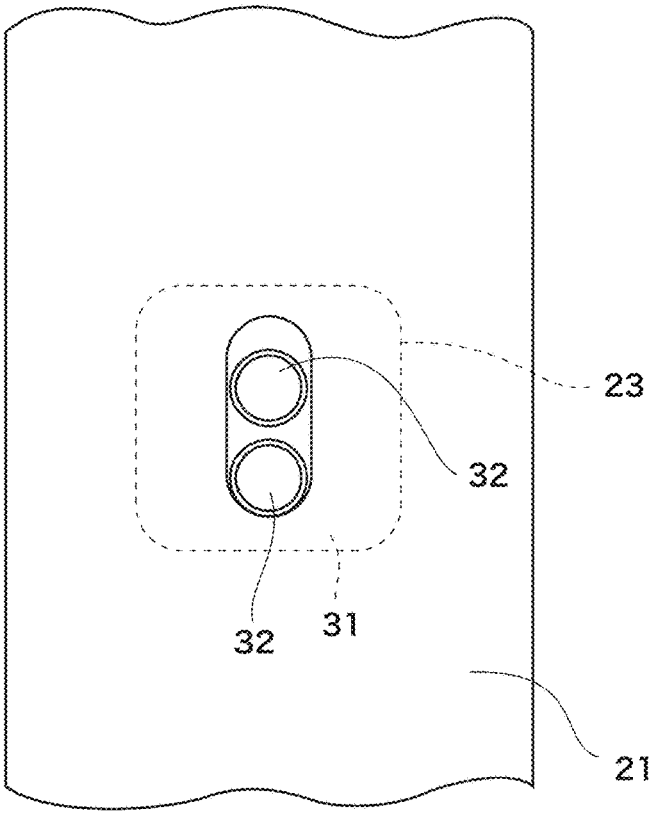
FIG. 9 is a fragmentary enlarged perspective view of the front side of the cushion plunger mounting part of the handle riser according to the embodiment of the present invention, in which the cushion plunger mounting block is fitted to the back side upside down with respect to the one shown in FIG. 8 in the longitudinal direction of the handle riser as shown in FIG. 7.

In this embodiment, the block 31 has two cushion plunger mounting holes 32. Of the two cushion plunger mounting holes 32, the one nearer to the edge of the block 31 is located at the position of 3 mm from the edge of the block 31. Therefore, as shown in FIG. 5 and other figures, the margin from the cushion plunger mounting hole 32 nearer to the edge to the edge of the block 31 is 3 mm.

The diameter of the cushion plunger mounting hole 32 nearer to the edge as an internally threaded hole is 11 mm. The cushion plunger mounting hole 32 nearer to the center is spaced 1 mm from the cushion plunger mounting hole 32 nearer to the edge and has a diameter of 11 mm.

Therefore, the distance between the cushion plunger mounting hole 32 nearer to the center and the edge of the block 31 is 8 mm.

The two cushion plunger mounting holes 32 in the block 31 are positioned eccentrically in the longitudinal direction of the handle riser 21. In this embodiment, the cushion plunger mounting holes 32 are deviated from the center of the block 31 in the longitudinal direction of the handle riser 21 and not symmetrical.

The block 31, block housing hole 23 and so on constitute a cushion plunger mounting device A.

By replacing the block 31 in the block housing hole 23 with the cushion plunger mounting holes 32 reversed in the longitudinal direction of the handle riser 21, more types of cushion plunger mounting holes 32 than the number of provided cushion plunger mounting holes 32 can be provided in the slotted hole 22.

In this embodiment, since two cushion plunger mounting holes 32 are provided, by replacing the block 31 in the block housing hole 23 with the cushion plunger mounting holes 32 reversed in the longitudinal direction of the handle riser 21, four types of cushion plunger mounting holes 32 are provided in the slotted hole 22.

Therefore, by turning the block 31 upside down and placing it in the block housing hole 23, four types of positions of cushion plunger mounting holes 32 can be provided.

The block 31 is turned upside down and placed in the block housing hole 23. One of the two cushion plunger mounting holes 32 exposed from the slotted hole 22 is selected and the cushion plunger 41 is mounted above the grip part 211 of the handle riser 21 of the archery bow 11.

Figure 10:
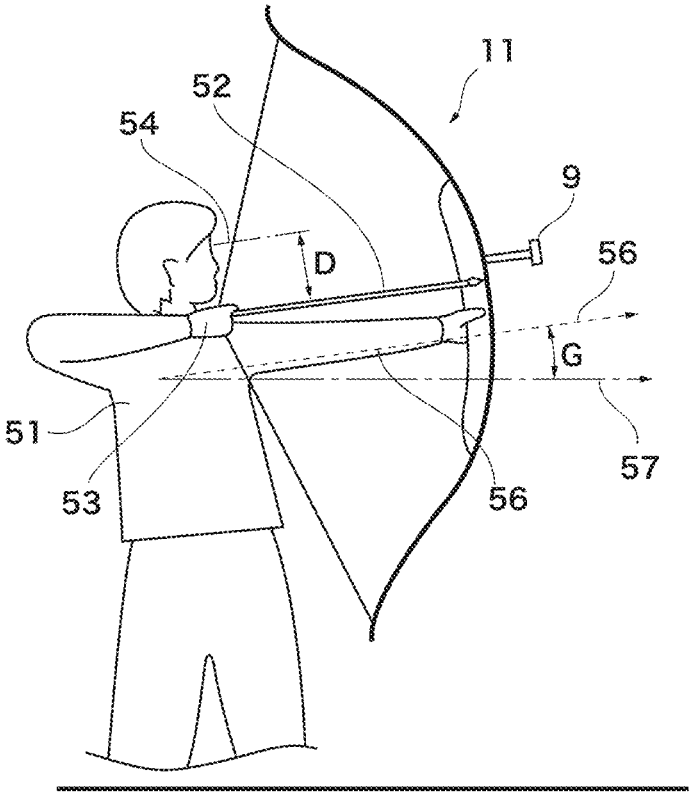
FIG. 10 is an explanatory view which shows the eye height position, the finger hooking position, the position of the sighting device, and the elevation angle of the pushing hand when the archer launches an arrow.
Figure 11:
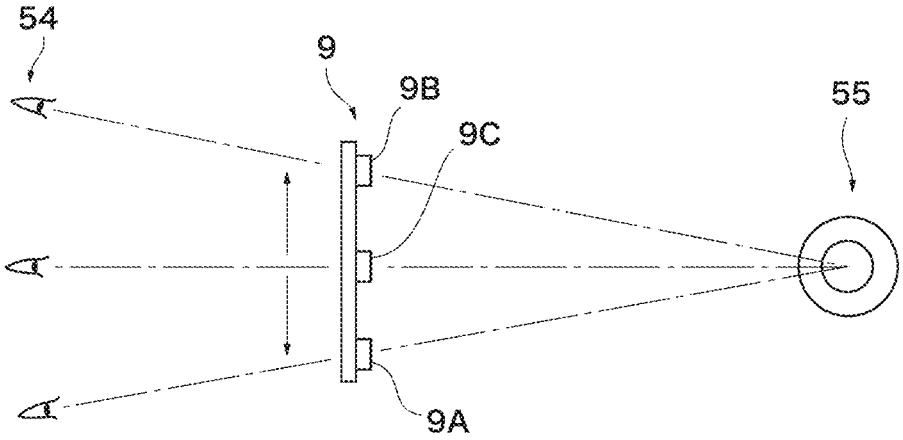
FIG. 11 is an explanatory view which shows the relation among the archer's eye height position (archer's height, distance between the eyes and jaw, finger hooking height), the height position of the sighting device, and the height position of the target (fixed).

In FIG. 10, 51 denotes an archer, 52 denotes an arrow, 53 denotes a finger hooking position, 54 denotes the height of the eyes, 9 denotes a sighting device, 56 denotes the pushing hand of the archer, and 57 denotes the horizon plane. Angle G indicates the elevation angle of the pushing hand, which is the angle between pushing hand virtual line 56*a* and horizon plane virtual line 57*a*. The sighting device 9 can be moved up and down freely and each archer can adjust its height.

For a person with a relatively short distance between the eyes and jaw (A1), a person with a high finger hooking position (A2) or a short-statured person (A3), if the person launches the arrow 52 with the sighting device 9 at the standard height position (9C), since the height of the target 55 is fixed (130 cm), the arrow will fly more downward than usual. Therefore, when the setting position of the cushion plunger 41 is fixed as in the past, the height of the sighting device 9 must be lowered (9A) to adjust the flying direction of the arrow 52.

In this case, the position of the cushion plunger mounting hole 32 used to mount the cushion plunger 41 is made higher to raise the cushion plunger 41 and arrow rest so that the arrow trajectory can be adjusted upward without changing the height of the sighting device 9 (fine adjustment of the height of the sighting device may be made about 0.1 mm to 1.0 mm by the archer during a game). Therefore, the elevation angle G of the pushing hand 56 can be decreased.

Similarly, in the case of a long-distance game, the position of the cushion plunger mounting hole 32 used to mount the cushion plunger 41 is made higher in advance. Consequently, the elevation angle G of the pushing hand 56 can be optimized.

On the other hand, for a person with a relatively long distance between the eyes and jaw (B1), a person with a low finger hooking position (B2) or a tall person (B3), if the person launches the arrow 52 with the sighting device 9 at the standard height position (9C), similarly the arrow 52 will fly more upward than usual. Therefore, the height position of the sighting device 9 must be raised (9B) to adjust the flying direction of the arrow 52.

In this case, the position of the cushion plunger 41 and arrow rest can be adjusted so as to be lowered to make the arrow fly downward without changing the position of the sighting device 9.

In this embodiment, by setting the pivot point at a position lower than the center of the bow (longitudinal direction), the arrow setting position can be made nearer to the center of the bow. Accordingly, when launching the arrow, power can be transmitted to the arrow smoothly.

Furthermore, in the recent years, only 70 m long-distance games have been played in the Olympics Games and FITA certified events. Therefore, the cushion plunger 4-step mounting device according to the present invention will exhibit its power.

REFERENCE NUMERALS

11 . . . archery bow
12 . . . limb
21 . . . handle riser
211 . . . grip part
22 . . . slotted hole
31 . . . block
32 . . . cushion plunger mounting hole
33 . . . block mounting hole
41 . . . cushion plunger
A . . . cushion plunger mounting device

The invention claimed is:

1. A cushion plunger mounting device comprising:

a block provided so that, when the block is attached to a handle riser of an archery bow, a plurality of cushion plunger mounting holes for mounting a cushion plunger are arranged in a row in a longitudinal direction of the handle riser;

a slotted hole that extends though the handle riser by penetrating from a first side of the handle riser to a second side of the handle riser, the slotted hole is configured to be in alignment with the cushion plunger mounting holes when the block is attached to the handle riser; and a block housing hole that is located around the slotted hole, the block housing hole extends into the handle riser from the first side of the handle riser without penetrating through the handle riser to the second side of the handle riser.

2. The cushion plunger mounting device according to claim 1, wherein the cushion plunger mounting holes are deviated from a center of the block in the longitudinal direction of the handle riser.

3. The cushion plunger mounting device according to claim 2, wherein the cushion plunger mounting holes are two holes.

4. The cushion plunger mounting device according to claim 1, wherein the cushion plunger mounting holes are two holes.

5. The cushion plunger mounting device according to claim 1, wherein the block housing hole houses the block.

6. The cushion plunger mounting device according to claim 1, wherein the block housing hole is a recess in the handle riser that retains the block.

* * * * *